United States Patent [19]

Rogers

[11] 4,170,308

[45] Oct. 9, 1979

[54] HYDRAULIC FUNCTION DISCONNECT MEANS

[75] Inventor: Richard E. Rogers, Waverly, Iowa

[73] Assignee: Koehring Company, Milwaukee, Wis.

[21] Appl. No.: 847,670

[22] Filed: Nov. 1, 1977

[51] Int. Cl.[2] ..... B66D 1/56; F01L 31/00

[52] U.S. Cl. ..... 212/39 DB; 91/358 A; 251/77; 254/174

[58] Field of Search ..... 212/39 R, 39 D, 39 DB, 212/39 MS; 254/168, 174; 91/358 A; 251/77

[56] References Cited

U.S. PATENT DOCUMENTS

| | | | |
|---|---|---|---|
| 1,558,635 | 10/1925 | Rutan | 212/39 B |
| 3,776,099 | 12/1973 | Knutson | 91/358 A |
| 4,067,447 | 1/1978 | Goss et al. | 212/39 B X |
| 4,099,449 | 7/1978 | Orimoto et al. | 91/358 A |

*Primary Examiner*—Robert G. Sheridan

[57] ABSTRACT

A hydraulic function disconnect means is interposed between an operator's control lever and a spring centered hydraulic control valve for a hydraulic motor actuator. The means is operable when the hydraulically actuated element approaches a limit position to prevent any operation of the valve by the lever which would move the element toward the limit position while permitting operation of the valve which results in movement of the element away from the limit position. A solenoid operated detent is used to control the ability of the disconnect means to transmit movements of the lever to the valve. The hydraulic function disconnect means forms part of the linkage in a two blocking prevention device used on boom-type material handling equipment such as a cable equipped crane in which the hydraulically actuated element comprises the movable hook and the cable is drawn in or paid out by a hydraulic motor actuator.

18 Claims, 4 Drawing Figures

HYDRAULIC FUNCTION DISCONNECT MEANS

BACKGROUND OF THE INVENTION

1. Field of the Invention

The present invention relates to a collapsible or extendible linkage suitable for use with a spring centered hydraulic valve and operator's control level in material handling equipment.

2. Description of the Prior Art

In equipment energized by a hydraulic circuit it is often necessary or desirable to arrest the motion of a hydraulically actuated element in one movement direction while permitting movement to occur in another direction. Such a situation can occur when the movable element approaches a limit position as for example, a movable hook block on a crane having an extendible boom and an operator controlled hydraulic motor for driving the cable drum of a winch. If an operator mistakenly hoists the cable too quickly, the hook block will contact the block in the boom head causing possible damage to components, and/or the load to slip from the hook block. A similar result occurs if without simultaneously paying out the cable, the operator extends the boom or pivots upwardly or downwardly a boom of the type having a winch mounted remotely therefrom. In any case, it is desirable to quickly disable the hydraulic component causing action in the direction that would provide this condition and thereby avoid severe damage to the crane. Apparatus which provides such operation is commonly called a "two blocking prevention device".

The foregoing is conventionally accomplished by adding or modifying components in the hydraulic circuitry for the motor. These components are responsive to the presence of the element in the limit position to stop or divert the flow of hydraulic fluid energizing the motor or reduce its pressure to prevent further movement of the element toward the limit position while permitting movement away from the limit position. However, the addition or modification of the necessary hydraulic components adds undesirable expense and complexity to the hydraulic circuitry.

SUMMARY OF THE PRESENT INVENTION

It is, therefore, the object of the present invention to provide an improved means for controlling the movement of an hydraulically actuated element. The improved means permits unhindered movement of the element in either direction except when the element approaches a limit position. In this condition further movement into the limit position is prevented while movement away from or out of the limit position is permitted. The present invention is thus suitable for use in a two blocking prevention application on a boom-type material handling device such as a cable equipped crane or the like.

The gist of the present invention is to obtain such operation by an element limiting, or function disconnect, means interposed in the linkage between a directional control valve for the hydraulic motor actuator for the element and the operator's control lever. Under normal operation, the disconnect means transmits movements of the control lever to the valve for energizing the actuator in either movement direction. When the movable element attains the limit position, the disconnect means in cooperation with a sensor means prevents transmission of control lever movements to the valve which would otherwise cause displacement of the element into the limit position. The valve assumes a spring biased, neutral position, deenergizing the hydraulic actuator. However, the disconnect means remains capable of transmitting control lever movements which operate the valve to move the element out of the limit position. The desired operation of the hydraulically actuated element is thus simply, economically and reliably obtained.

DESCRIPTION OF THE PREFERRED EMBODIMENT

Figure 1:
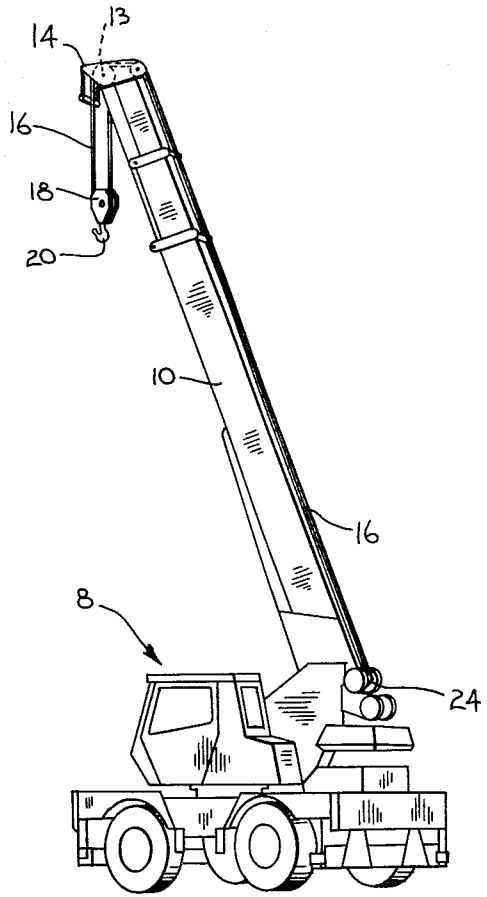
FIG. 1 is a view in elevation of a crane equipped with a hydraulic function disconnect means in accordance with the present invention.

FIG. 1 illustrates a mobile crane 8 having an extendible boom 10 at the lower end of which at least one winch 24 is mounted. A hoist cable 16 is wound on the winch 24 and extends upwardly along the top of boom, over sheaves 13 mounted in the boom head block 14. The cable 16 then passes downwardly in a reeved arrangement to a movable block 18 containing hook 20 for supporting a load. By drawing in and paying out cable 16, hook block 18 and any additional load may be raised and lowered.

Figure 2:
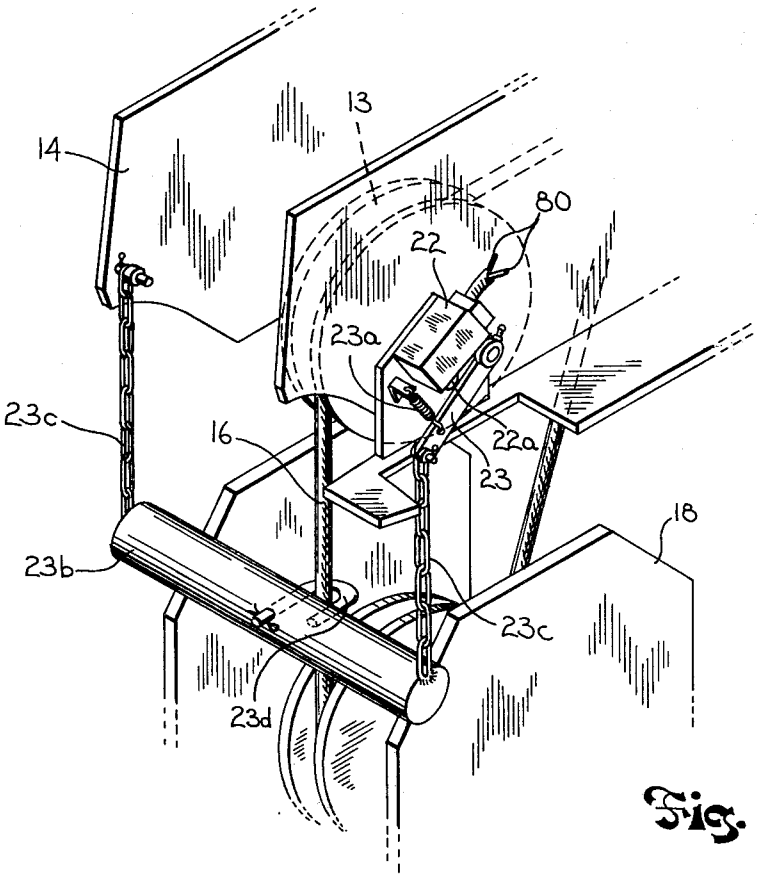
FIG. 2 is a fragmentary illustration of the boom head portion of the crane showing the hook block and related elements.

To ascertain when cable 16 has been drawn in to an extent sufficient to raise hook block 18 into contact with boom head block 14, a sensor device in the form of normally closed limit switch 22 is located on the boom head block 14. As seen in FIG. 2, a lever 23 is pivotally connected to the boom head block 14 and tends to be drawn upwardly into contact with the actuator **22*a* of switch 22 by means of tension spring 23*a*. In normal operation, however, the lever 23 is kept away from the actuator 22*a* of the switch 22 by the pull of a weight 23*b* suspended by chains 23*c* from the lower end of the lever 23 and the boom head block 14. The weight 23*b* includes a looped cable guide 23*d* through which the hoist cable 16 is fed, and is positioned to be engaged by the hook block 18 when the block is raised and approaches a position of contact with the underside of the boom head block 14. The lever 23 can then be sprung into contact with the actuator 22*a* of the switch 22, opening the switch 22 and deenergizing, through wires 80**, the hydraulic function disconnect device hereinafter described.

Figure 3:
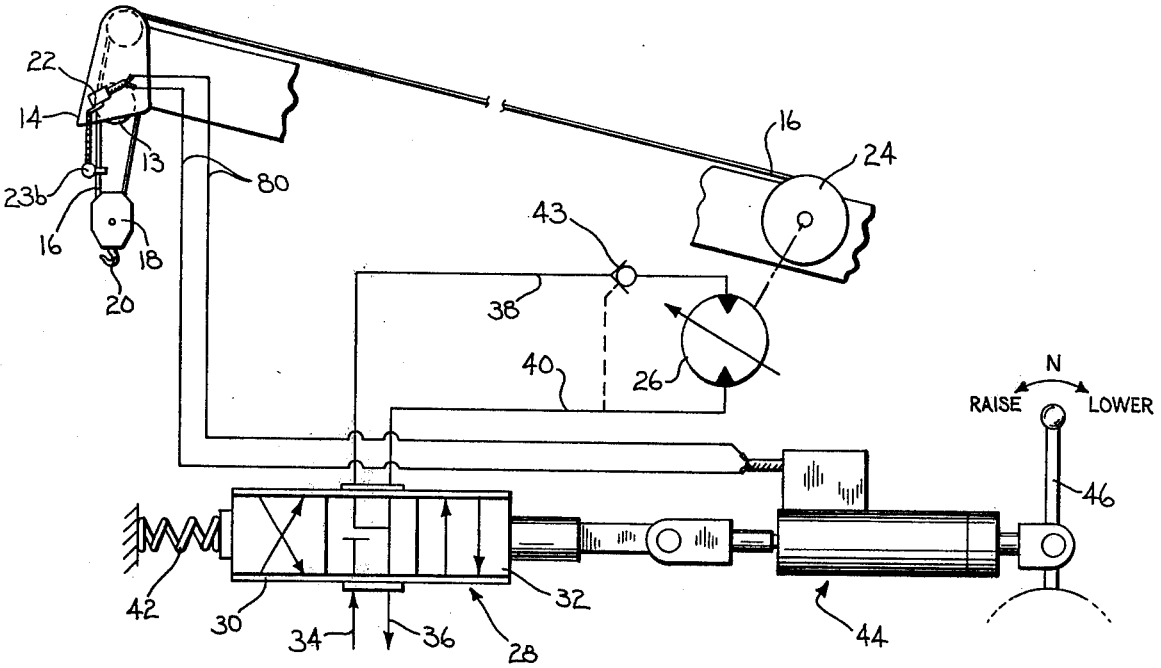
FIG. 3 is a schematic diagram of portions of a hydraulic control circuit for raising and lowering the hook block in the crane.

FIG. 3 shows winch 24 about which cable 16 is wound and unwound to draw in and pay out the cable. Winch 24 is driven by hydraulic motor 26 controlled by hydraulic valve 28. Hydraulic control valve 28 may be a four way, three position valve comprised of valve body 30 and valve spool 32, shown diagrammatically in FIG. 3. Fluid supply conduit 34 and fluid return conduit 36 are connected to valve body 30. Conduits 38 and 40 connect hydraulic control valve 28 with hydraulic motor 26. Valve spool 32 is biased into a neutral position by spring 42, typically located at one end of spool 32. Movement of valve spool 32 out of the neutral position to the left, as shown in FIG. 3, connects conduit 34 and 36 to conduits 38 and 40 to drive motor 26 and winch 24 in a direction to wind cable 16 onto winch 24. Movement of valve spool 32 out of the neutral position to the right, as shown in FIG. 3, connects conduits 34 and 36 to conduits 38 and 40 to drive motor 26 and winch 24 in a direction to unwind cable 16 off of winch 24. Hydraulic valve 28 is shown in FIG. 3 as having open center work ports. The hydraulic control circuit contains pilot operated check valve 43 for holding the load when valve 30 is in the neutral position.

Spool 32 of valve 28 is connected to one end of hydraulic function disconnect means 44. The other end of hydraulic function disconnect means 44 is connected to operator control lever 46. Lever 46 is movable to a neutral position, a "Raise" control position for winding up cable 16 and raising hook block 18 and a "Lower" control position for unwinding cable 16 and lowering hook block 18.

Figure 4:
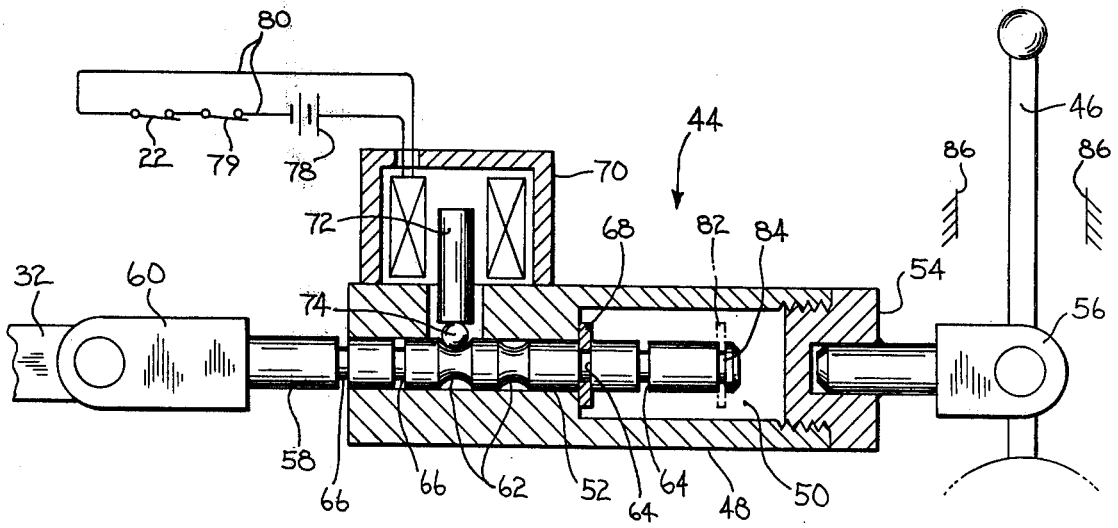
FIG. 4 is a cross sectional view of the hydraulic function disconnect means of the present invention.

Hydraulic function disconnect or element movement limiting means 44 which serves as part of the two blocking prevention device in the crane is interposed between valve 28 and operator control lever 46 as all or a portion of the linkage between the two elements. As shown in detail in FIG. 4, disconnect means 44 includes elongated body 48 containing chamber 50 and bore 52. Chamber 50 is closed by cap 54 having a connection means, such as clevis 56, extending therefrom suitable for attachment to operator lever 46 or spool 32 of valve 28.

Bar 58 is mounted for movement in bore 52. One end of bar 58 extends into chamber 50. A second connection means 60 suitable for connection to the other of operator lever 46 or spool 32 is mounted on the exposed end of bar 58.

Bar 58 contains preferably one, but may also contain more than one, semicircular annular groove 62 positioned in the central portion thereof so as to be located within bore 52. Bar 58 also contains annular recesses 64 adjacent the end in chamber 50 and annular recesses 66 adjacent the exposed end of bar 58. Recesses 64 and 66 are suitable for receiving a snap ring 68. Depending on the function to be disconnected, a snap ring 68 is inserted in one of recesses 64 and 66. In the exemplary embodiment shown in FIG. 4, snap ring 68 is inserted in one of recesses 64.

Solenoid 70 is mounted on body 48 so that the plunger 72 moves normal to the axis of bar 58. Detent ball 74 is mounted under plunger 72 for being biased into annulary groove 62 by the energization of the solenoid. Solenoid 70 is connected to switch 22, through battery 78 and ignition switch 79, by wires 80.

In operation, as long as hook block 18 is not in contact with boom head block 14, switch 22 is closed, energizing solenoid 70. Detent ball 74 is forced into annular groove 62 by the activation of the solenoid. The positioning of detent ball 74 in groove 72 prevents relative movement between body 48 and bar 58 so that the movements of operator lever 46 to either the "Raise" or "Lower" position are transmitted to hydraulic control valve 28 to shift the position of valve spool 32, resulting in the appropriate operation of hydraulic motor 26 and winch 24.

Should cable 16 be wound up on winch 24 to the point where hook block 18 contacts weight 23*b* suspended from the boom head block 14, switch 22 will be opened as hook block 18 relieves the weight of 23*b* from lever 23 causing actuaction of switch 22. The opening of switch 22 deenergizes solenoid 70, freeing ball 74. With ball 74 freed, bar 58 is similarly free to move inward in chamber 50 responsive to the pressure of centering spring 42 of valve 28. The linkage provided by disconnect means 44, in effect, selectively collapses when the limit position is attained. The action of spring 42 returns valve spool 32 to the neutral position deenergizing hydraulic motor 26 and preventing further movement of winch 24 and damage to the components of crane 8.

With ball 74 freed and the linkage collapsed, disconnect means 44 is incapable of transmitting any movement of operator lever 46 into the "Raise" position to hydraulic control valve 28 since such movement merely slides body 48 along bar 58. Bar 58 is held stationary by spring 42. The length of the exposed end of bar 58 is greater than the amount of movement provided to body 48 by lever 46 as determined by travel limits 86 so that abutment of body 48 with connection means 60 is avoided as is also the spacing between the end of bar 58 and the inner surface of cap 54 for the avoidance of abutment between these elements. Valve spool 32 of hydraulic control valve 28 thus cannot be moved to the left to energize hydraulic motor 28 in the wind up direction.

However, movements of operator control lever 46 to the "Lower" position are transmitted through disconnect means 44 to hydraulic control valve 26 due to the abutment of snap ring 68 with the bottom of chamber 50 when body 48 is pulled to the right by lever 46. This permits the operator to move valve spool 32 of hydraulic control valve 28 to the right to energize hydraulic motor 26 in the unwind direction so that hook block 18 may be lowered out of contact with boom head block 14.

The lowering of hook block 18 closes switch 22 reenergizes solenoid 70 and applies a downward bias on ball 74 tending to eat ball 74 in semicircular groove 62 on bar 58. Movement of operator control lever 46 to the "Lower" position locates body 48 and bar 58 so that ball 74 is returned to groove 62. Full operation of hydraulic control valve 28 by operator control lever 46 is thus restored.

The use of deenergization of the solenoid to initiate collapse of the linkage provides a fail safe feature to the disconnect means both in the operation described above and in the event of the loss of electrical power due to malfunctions in crane 8.

The plurality of recesses 64 in the end of bar 58 permits the length of disconnect means 44 to be adjusted to accomodate various distances between operator lever 48 and hydraulic control valve 28. The plurality of grooves 62 accomodates ball 74 in the different positions.

To reverse the disconnect function, snap ring 68 is placed in one of recesses 66 adjacent connection means 60. This prevents transmission of movement through disconnect means 44, when solenoid 70 is deenergized, which would attempt to move valve spool 32 to the right but permits disconnect means 44 to transmit movements of operator lever 46 to hydraulic control valve 28 which moves valve spool 32 to the left. Snap ring 82 is placed in recess 84 at the end of bar 58 to prevent inadvertent separation of body 48 and bar 58.

While the hydraulic function disconnect means of the present invention has been described in the control of hydraulic motor 26 for cable 16, it will be appreciated that the disconnect means may be employed in connection with other elements, such as the hydraulic actuators which extend the boom or raise and lower the boom. Operation of these actuators also causes the same two-blocking condition and has greater potential for damage since the actuators may comprise hydraulic cylinders capable of exerting much greater forces than hydraulic motor 26.

Various modes of carrying out the invention are contemplated as being within the scope of the following claims particularly pointing out and distinctly claiming the subject matter which is regarded as the invention.

I claim:

1. In a boom type material handling device having a movable element associated with the boom, fluid motor means for moving the element, valve control means for controlling the motor means, manually-controlled actuator means for actuating the valve control means, linkage means connecting the actuator means to the control means, and sensor means for sensing the position of the movable element with respect to the boom, the improvement comprising:

element movement limiting means forming a part of the linkage means and operatively connected and responsive to the sensor means for being placed in a pair of operative conditions thereby, said limiting means transmitting motion from the actuator means to the control means in a first condition and permitting movement of the actuator means without resultant movement of the control means in a second or limit condition.

2. In a cable equipped crane provided with a hydraulic control means having a hydraulic actuator for moving a hook block element toward and away from a limit condition with respect to a boom head block, a sensor for detecting when said element attains the limit condition, a hydraulic control valve means coupled to said hydraulic actuator, and an operator control means movable to a pair of control positions corresponding to the toward and away movement of said element, the two blocking prevention device including:

a hydraulic function disconnect device interposed between the hydraulic control valve means and the operator control means and forming at least a portion of a linkage between the two for transmitting movements of the operator control means to the control valve means in a first condition, said disconnect device being coupled, to the sensor and responsive thereto for preventing transmission, to the valve means, of movements of the operator control means corresponding to movement of the element toward the limit condition when the sensor ascertains the element is in the limit condition.

3. The two blocking prevention device according to claim 2 wherein said hydraulic function disconnect device includes a body coupled to one of said means and a bar journalled in said body and reciprocally movable with respect thereto, said bar being coupled to the other of said means, said disconnect device further including apparatus responsive to the sensor for preventing relative movement of said body and bar for transmitting movements of the operator control means to the valve means and for allowing relative movement between said body and bar to prevent transmission of operator control means movements to the valve means.

4. The two blocking prevention device according to claim 3 wherein said hydraulic function disconnect device further includes a first stop operatively associated with said body and bar for preventing movement of said bar with respect to said body for transmitting those movements of the operator control means that cause movement of the element away from the limit condition.

5. The two blocking prevention device according to claim 4 wherein said hydraulic function disconnect device further includes a second stop operatively associated with said body and bar and coupled to said sensor for preventing movement of said bar with respect to said body for transmitting those movements of the operator control means that cause movement of the element toward the limit condition until the limit condition is attained and for permitting movement of said bar with respect to said body when said sensor means ascertains the element is in the limit condition for preventing transmission, to the valve means, of movements of the operator control means corresponding to movement of the element toward the limit condition.

6. In a hydraulic control circuit having a hydraulic actuator coupled to an element for moving same toward and away from a limit position, a sensor for detecting when said element attains the limit position, a hydraulic control valve means coupled to said hydraulic actuator, said valve means having flow control structure biased by a force producing device to a neutral position and displaceable out of said neutral position against said bias force to a pair of fluid flow permitting positions for energizing said hydraulic actuator to cause the toward and away movement of said element, and an operator control means movable to a pair of control positions corresponding to the toward and away movement of said element, the improvement comprising:

a hydraulic function disconnect device interposed between the hydraulic control valve means and the operator control means and forming at least a portion of a linkage between the two for transmitting movements of the operator control means to the valve menas for displacing the flow control structure to said flow permitting positions against the bias of said force producing device, said disconnect device including a body coupled to one of said means, a bar journalled in said body and reciprocally movable with respect thereto, said bar being coupled to the other of said means, a first stop operatively associated with said body and bar for preventing movement of said bar with respect to said body for transmitting those movements of the operator control means that place the valve means in the flow permitting position causing movement of the element away from the limit position; and a second stop operatively associated with said body and bar and coupled to said sensor for preventing movement of said bar with respect to said body for transmitting those movements of the operator control means that place the valve means in the flow permitting position causing movement of the element toward the limit position until the limit position is attained and for permitting movement of said bar with respect to said body when said sensor means ascertains the element is in the limit position for permitting the bias force of the flow control structure of return it to the neutral position and for preventing transmission, to the valve means, of movements of the operator control means corresponding to movement of the element toward the limit position.

7. The improvement of claim 6 wherein the sensor alters an electric signal condition when the element attains the limit position and wherein said second stop comprises electro-mechanical apparatus responsive to alteration of the electrical signal condition.

8. The improvement of claim 7 wherein said body contains a bore in which said bar is journalled for reciprocal movement and wherein said second stop comprises detent means mounted on said body and selectively engageable with said bar.

9. The improvement according to claim 8 wherein said bar contains at least one groove positionable within said bore when said hydraulic function disconnect means is in a movement transmitting condition and wherein said second stop includes electro-mechanical detent means insertable in said groove for preventing relative movement between said body and bore and movable out of said groove for permitting such movement.

10. The improvement according to claim 9 wherein said groove is located about the periphery of said bar and wherein said detent means is insertable and removable in said groove in a direction generally perpendicular to the direction of reciprocal movement of said bar.

11. The improvement according to claim 10 wherein said electro-mechanical detent means comprises a solenoid having plunger means insertable in said groove and movable out of said groove.

12. The improvement according to claim 11 wherein said plunger means has a detent ball operatively associated therewith for insertion in said groove and movable out of said groove responsive to forces applied to said hydraulic function disconnect means when the solenoid is deenergized.

13. The improvement according to claim 9 including means for adjusting the position of said bar with respect to said body when in the movement transmitting condition thereby to adjust the length of said hydraulic function disconnect means.

14. The improvement according to claim 6 wherein said first stop comprises means mounted on said bar for contacting said body to prevent movement of said bar in one direction with respect to said body.

15. The improvement according to claim 14 wherein said first stop comprises a snap ring surrounding said bar and abuttable with said body.

16. The improvement according to claim 13 wherein said bar has a plurality of grooves and said first stop has a plurality of positions for operative association with said bar and body for adjusting the length of said hydraulic function disconnect means.

17. The improvement according to claim 14 wherein said first stop is mounted on said bar so as to prevent movement of said bar in a first of the two directions of reciprocal movement with respect to said body.

18. The improvement according to claim 14 wherein said first stop is mounted on said bar so as to prevent movement of said bar in a second of the two directions of reciprocal movement with respect to said body.

* * * * *